US006557478B2

(12) United States Patent
Sherwin et al.

(10) Patent No.: US 6,557,478 B2
(45) Date of Patent: May 6, 2003

(54) AUTOMATIC BINDING MACHINE

(76) Inventors: Stephen J. Sherwin, P.O. Box 154, Valencia, PA (US) 16059; George W. Sherwin, 1836 Foxcroft La. #502, Allison Park, PA (US) 15101

( * ) Notice: Subject to any disclaimer, the term of this patent is extended or adjusted under 35 U.S.C. 154(b) by 60 days.

(21) Appl. No.: 09/928,951

(22) Filed: Aug. 13, 2001

(65) Prior Publication Data

US 2002/0020335 A1 Feb. 21, 2002

Related U.S. Application Data

(60) Provisional application No. 60/224,985, filed on Aug. 14, 2000.

(51) Int. Cl.[7] ..... D05B 35/10; D05B 23/00

(52) U.S. Cl. ..... 112/475.04; 112/470.13

(58) Field of Search ..... 112/141, 148, 112/153, 217.1, 309, 308, 318, 2.1, 470.07, 470.12, 470.13, 470.17, 118, 475.03, 475.04, DIG. 2, DIG. 3; 83/72, 100, 177, 370, 734, 565, 901, 910, 936; 239/265.23, DIG. 8, DIG. 9; 29/421.5, DIG. 50, DIG. 63

(56) References Cited

U.S. PATENT DOCUMENTS 3,641,954 A * 2/1972 Kalning et al. ..... 112/2.1
4,062,307 A 12/1977 Michelberger ..... 112/7
4,601,249 A * 7/1986 Frye ..... 112/470.13
4,722,290 A 2/1988 Manuel et al. ..... 112/153
5,018,462 A 5/1991 Brocklehurst ..... 112/121.12
5,216,969 A 6/1993 Thomas et al. ..... 112/7
5,560,308 A * 10/1996 Eto ..... 112/470.07
5,647,293 A * 7/1997 Price et al. ..... 112/470.17
5,875,723 A 3/1999 Lobur ..... 112/7
6,014,938 A * 1/2000 Uto ..... 112/470.18

* cited by examiner

*Primary Examiner*—Ismael Izaguirre
(74) *Attorney, Agent, or Firm*—Webb Ziesenheim Logsdon Orkin & Hanson, P.C.

(57) ABSTRACT

A contour following machine for altering the edge of a material, which includes a horizontal work surface, a dial plate, through which a vacuum may be drawn, situated on the horizontal work surface, an edge-altering device, a rotary table upon which the edge-altering device is positioned, and a cut-out channel through which a connection between the dial plate and the vacuum is established. The edge-altering device is located at an end of the horizontal work surface and the cut-out channel extends to a far end of the cut-out channel positioned beyond a center point of the horizontal work surface. The dial plate can be moved to any position between the far end of the cut-out channel and the edge-altering device end of the cut-out channel. The edge-altering device may be a sewing machine, a knife, or a water jet.

34 Claims, 3 Drawing Sheets

AUTOMATIC BINDING MACHINE

CROSS-REFERENCE TO RELATED APPLICATION

This application claims priority from U.S. Provisional Patent Application Serial No. 60/224,985, filed Aug. 14, 2000, and entitled "Automatic Binding Machine".

BACKGROUND OF THE INVENTION

1. Field of the Invention

The present invention relates to an apparatus and method for altering the edges of a piece of fabric. More particularly, the present invention is directed to an apparatus and method for producing bound or sewn edges extending continuously along the periphery of a piece of heavy fabric, such as an area rug or automotive floor mat.

2. Description of the Prior Art

It is often the case that the precut carpet sections are cut from a carpet roll and the edges stitched by an operator-controlled sewing machine, with the operator guiding the carpet section manually. When one edge of, for example, a rectangular section is completed, the operator rotates the sample 90° and continues sewing the second edge. This requirement that the sample be rotated at the proper time and to the proper orientation requires a degree of skill and a high degree of concentration on the part of the operator. In a mass production environment, such requirements can be both stressful and tiring, leading to error and consequent wastage. The edging procedure continues until all four edges of the sample have been sewn, whereupon the operator removes the carpet section from the machine. Because the carpet material is usually fairly heavy and stiff, the entire process can be quite tiring for the operator in addition to being slow and, of course, labor intensive. Examples of binding machines that can be used as described above are disclosed in U.S. Pat. No. 4,062,307 to Michelberger and U.S. Pat. No. 5,875,723 to Lobur.

U.S. Pat. No. 5,018,462 to Brocklehurst discloses an apparatus for finishing the edges of flat, soft textile products, such as wash cloths and the like. The apparatus disclosed by Brocklehurst includes a transport plate, which bears against the cloth piece being edged and moves it into a sewing machine in response to a first sensor being covered. As the trailing edge of the piece passes over and uncovers a second sensor or detector, the transport plate rotates. By rotating the workpiece through, for example, an angle of 90°, the first and second sensors are covered, and the workpiece is advanced by the plate until the second sensor is again uncovered. The arrangement disclosed by Brocklehurst cuts an edge in the material and immediately thereafter stitches the cut edge around the periphery of the workpiece. This apparatus works effectively for small, relatively-light, and flexible pieces of fabric, but is ill suited for large heavy sections of carpet.

Other prior art arrangements utilize sensors to detect when to rotate the workpiece, such as shown in U.S. Pat. No. 4,722,290 to Manuel et al. The arrangement disclosed by Manuel et al. has the sensors placed on the sewing machine, which trims the edge of the workpiece prior to sewing the edges. This arrangement works well for soft materials, such as towels, wash cloths, and the like, which are relatively-thin and flexible, but is ill-suited for large heavy sections of carpet.

U.S. Pat. No. 5,216,969 to Thomas et al. discloses an automated carpet binding apparatus particularly suited for small sections of heavily-piled, relatively-stiff materials. The apparatus disclosed by Thomas et al. has a robot member, which engages a piece of the material and forces it to bear against a fence along one edge. The robot moves the piece through a sewing station where tape is applied and sewn to the edge as it is pulled through the station by a splined wheel. A rotating mechanism rotates the piece 90° and the second edge is finished. When all four edges have been finished, a cutter removes any trailing tape. An automatic hopper moves pieces into position to be gripped and lifted by a gripper mechanism and placed on the work table for the robot to engage the piece.

There remains a need for a non-labor intensive device to bind the edges of pieces of heavy fabric, such as an area rug.

SUMMARY OF THE INVENTION

The present invention is directed to a contour following machine, such as a sewing machine, a knife, or a water jet, for altering the edge of a material. The present contour following machine includes a horizontal work surface; a dial plate through which a vacuum pump may draw a vacuum, the dial plate being situated on the horizontal work surface; an edge-altering device; a rotary table upon which the edge-altering device is positioned; and a cut-out channel through which a connection between the dial plate and the vacuum may be established. The edge-altering device is located at an end of the horizontal work surface. The cut-out channel extends from the edge-altering device end of the horizontal work surface to a far end of the cut-out channel located at a position extending beyond a center point of the work surface, such that the dial plate can be moved to any position between the far end of the cut-out channel and the edge-altering device end of the cut-out channel.

The present invention is further directed to a method for binding material using the above-described contour following machine. The present method generally includes inserting a binding material into a binder guide and placing the material onto a horizontal work surface such that the material is approximately centered over the dial plate. The material is moved by a linear actuator, which moves the dial plate and the material along the cut-out channel in the horizontal work surface toward a sewing head of a sewing machine, which rests on the rotary table. The rotary table is rotated such that the sewing machine and the sewing head are in a start position after which a sewing cycle is begun by penetrating the material with a sewing needle and beginning to sew using the sewing machine. The location of the edge of the material is detected using a first sensing arm connected to a first spring-loaded sensor and a second sensing arm connected to a second spring-loaded sensor. The position of the linear actuator and the angular location of the sewing head are corrected to provide a normal thread stitch, such that the sewing head maintains a tangential orientation to the edge of the material. The material is pulled through the sewing head by way of the action of the sewing needle and a presser foot. After a complete rotation of the material is detected, the sewing spindle is rotated to remove the needle from the material, the binder material thread is cut, and the completely edge-bound material is removed from the horizontal work surface.

DESCRIPTION OF THE PREFERRED EMBODIMENTS

Figure 1:
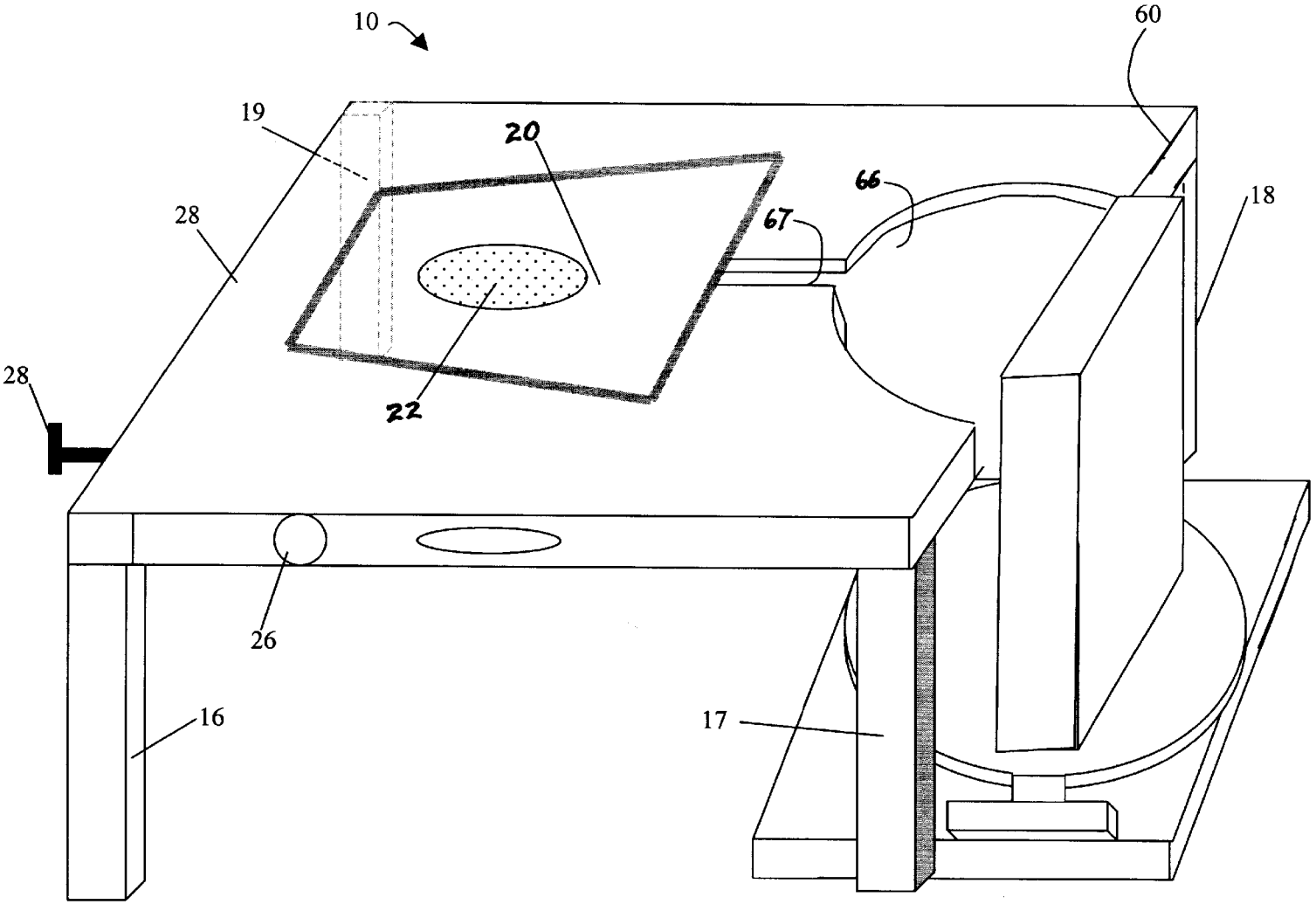
FIG. 1 is a perspective view of the automatic binding machine of the present invention.

Referring to FIG. 1, an automatic binding machine 10 includes a horizontal work surface, which may be a table top 14 of table 12, which has four legs 16, 17, 18 and 19 (leg 19 shown in phantom) as shown. The horizontal work surface is capable of supporting a large section of material 24, such as a 30"×30" carpet pad. The material 24 is placed on table top 14 (which has a suitable dimension, 48"×48", for example) by an operator at a location within about 3 inches to 4 inches of a center point 20 of table top 14. The material 24 rests on table top 14 and dial plate 22, which is a freewheeling disk. Dial plate 22 is preferably perforated to allow a vacuum to hold material 24 securely to dial plate 22.

Figure 2:
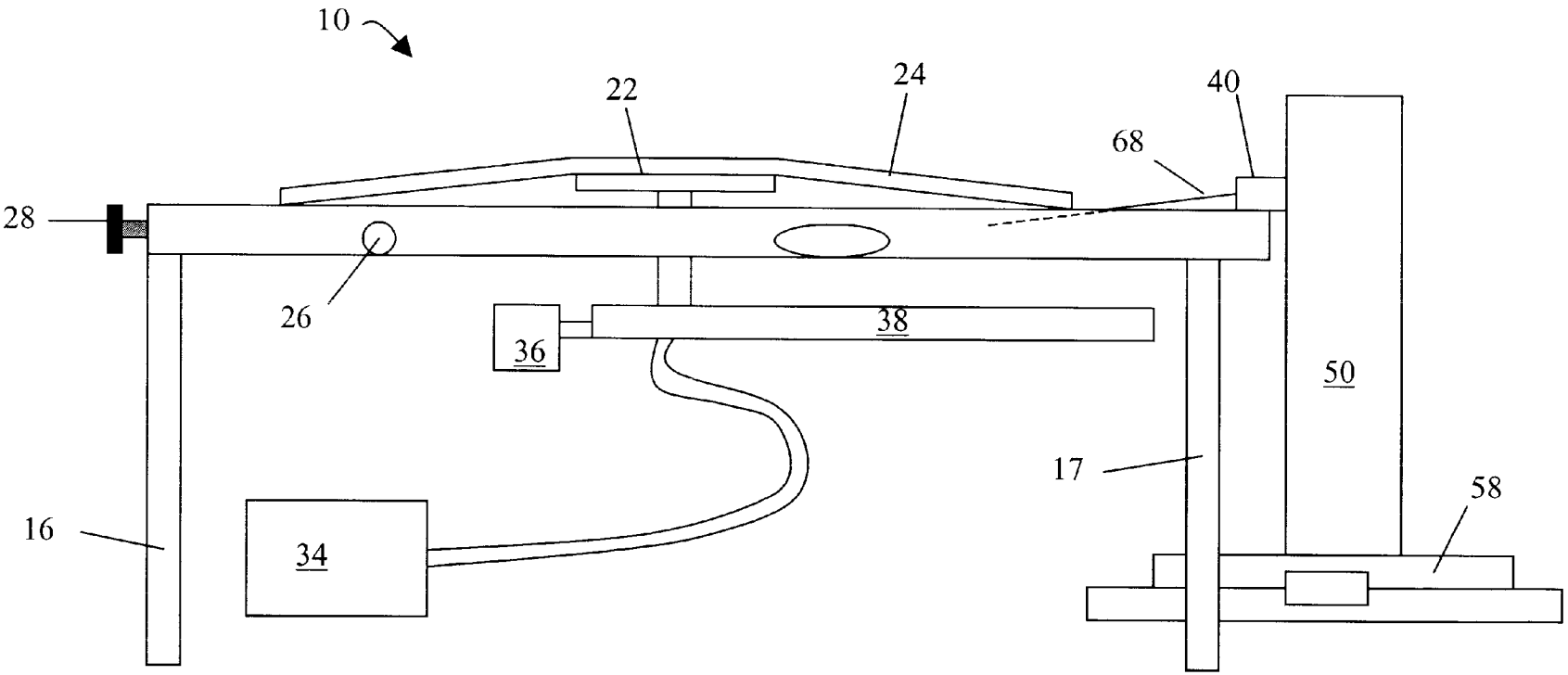
FIG. 2 is a side elevation view of the automatic binding machine of the present invention.
Figure 3:
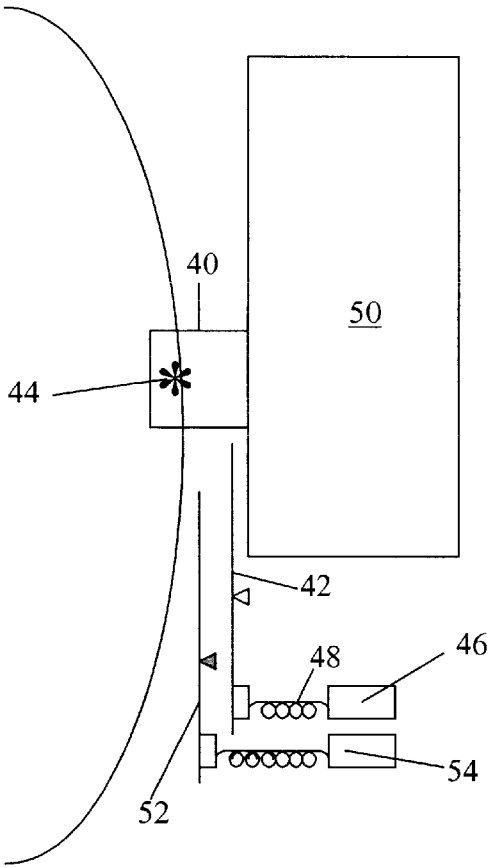
FIG. 3 is a partial plan view of the automatic binding machine of the present invention.

The operator places material 24 on table top 14 and activates at least one palm-start buttons, for example, first palm-start button 26 and second palm-start button 28, as shown in FIGS. 1 and 2, initiate a machine sewing cycle. Referring to FIG. 2, a vacuum pump 34 applies a vacuum to dial plate 22, which secures material 24 firmly to dial plate 22. After a one-second delay, motor 36 activates which drives linear actuator 38. Dial plate 22 is attached to linear actuator 38 and moves toward a sewing head 40 along a cut-out channel 67. Cut-out channel 67 extends from a sewing machine end 72 of the horizontal work surface to a far end of the cut-out channel (not shown) positioned beyond center point 20 of the horizontal work surface. Material 24, which is held against dial plate 22 by way of the applied vacuum, eventually touches a sensing arm 42 located near a sewing needle 44, as shown in FIG. 3. Sensing arm 42 is attached to a first spring-loaded sensor 46, a linear velocity displacement transducer (LVDT) or equivalent, and as sensing arm 42 pushes against a first spring 48, first spring-loaded sensor 46 approaches a null position and motor 36 stops. Material 24 remains at this null location due to the correction action of first spring-loaded sensor 46.

A null signal (or zero speed switch) activates a sewing machine 50, and the material 24 is pulled through sewing head 40 by the action of the sewing mechanism. Material 24 is free to move as it rotates on dial plate 22. As the sewing operation begins, any changes in carpet dimension from the center of dial plate 22 is automatically sensed by sensing arm 42, and automatic correction is made to maintain a desired position under sewing head 40.

As the sewing operation begins, a second sensing arm 52 senses any changes in the straight line of the edge of material 24 being pulled through sewing head 40. If the edge of material 24 is straight, sewing head 40 remains normal to dial plate 22. Should second sensing arm 52 detect a curve along the edge of material 24, a second spring-loaded sensor 54 will activate, by way of second spring 49, a second motor 56, such that a rotary table 58 will begin to rotate sewing head 40. In this way, sewing head 40 remains tangent with the edge of material 24.

Second spring-loaded sensor 54 does not activate until first spring-loaded sensor 46 reaches a null position. Second sensing arm 52 is set for null when second sensing arm 52 and sensing arm 42 are in a straight line with sewing head 40. Second motor 56 reacts to changes in the position of sensing arm 42 and second sensing arm 52 by rotating rotary table 58, which changes the orientation of sewing head 40 in either a clockwise or counterclockwise direction.

As sewing continues, sensing arm 42 will adjust the position of material 24 in and out by controlling linear actuator 38. As the curvature of the edge of material 24 changes, sewing head 40 rotates to a tangential position by feedback from second sensing arm 52.

Figure 4:
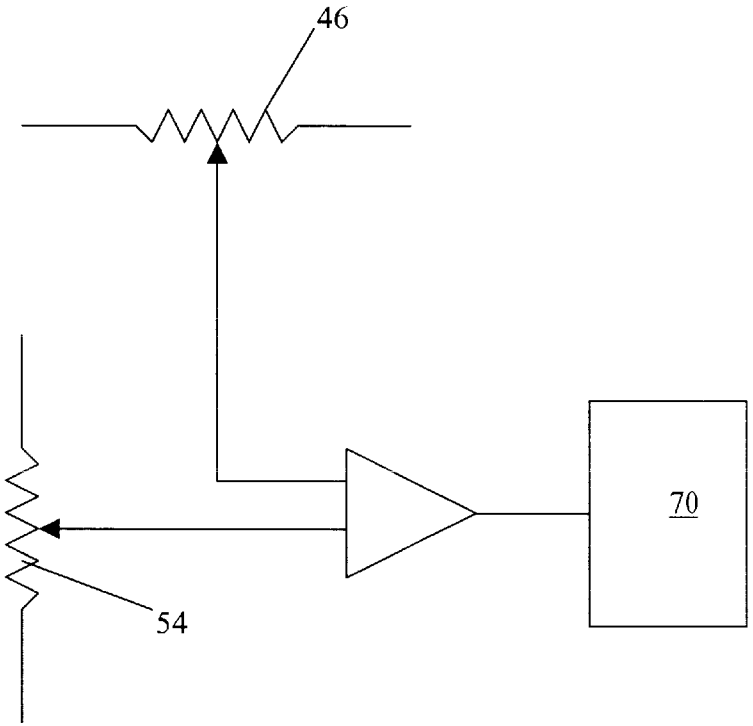
FIG. 4 is a schematic of a reverse signal circuit of the present invention.

Sewing continues at a rate based on the speed control setting on sewing machine 50, until dial plate 22 rotates 360°, at which time a detector switch 70 (shown in FIG. 4) will actuate and stop the sewing operation, thus ending a sewing cycle. At the end of a sewing cycle, first spring-loaded sensor 46 and second spring-loaded sensor 54 receive a reverse signal from detector switch 70 which is sent to linear actuator 38 and motor 36 to drive dial plate 22 back to its home position. When dial plate 22 is at its home position, a limit switch (not shown) removes all power from automatic binding machine 10, the vacuum on dial plate 22 is released, and the operator can remove the material 24 from table top 14. Automatic binding machine 10 is then ready to accept another item of material 24 to be processed. In an embodiment of the present invention, emergency shut-off button 30 may be pushed to cease operation of binding machine 10. Emergency shut-off button 30 operates by removing the power supplied to sewing machine 50, motor 36, and second motor 56.

An optional control that senses carpet curvature (not shown) can be considered in order to slow the speed of sewing under certain conditions. For example, when a small radius is detected by larger variations of second sensing arm 52 and sensing arm 42, it may be advisable to slow the speed of sewing, as sewing head 40 rotates around the small radius. This can be accomplished by combining the larger proportional variation of the sensing signal and combining this with the manual speed setting of sewing head 40 and using the differential as the resultant sewing speed. This function can be carried out using an operational amplifier and combining these two input signals in a different mode to control the sewing speed.

Sewing machine 50 is preset manually for size of stitch, pitch, speed, type of stitch, etc. Automatic feedback from second spring-loaded sensor 54 will be the only variable changing sewing speed around small radius curvature.

An optional pad securing technique could be employed by making use of an arm (not shown) extending from the rear of table 12 which applies pressure to the top of material 24 and dial plate 22 by activating a solenoid pressure plate (not shown). This arm must be attached to linear actuator 38 to move with dial plate 22 toward and away from sewing head 40. This could eliminate the need for a vacuum system, especially where material 24 could not be held in place with a vacuum.

The starting position of sewing head 40 should be approximately normal to dial plate 22 on start-up. If possible, material 24 should be placed on table top 14 with a reasonably-straight edge of material 24 on a side 60 of table top 14 that includes sewing head 40. This will allow a start sewing point to be reasonably at right angles to dial plate 22, and sewing head 40 will end the sewing cycle in this position before power is removed to ready automatic binding machine 10 for the next sewing cycle.

First spring-loaded sensor 46 and second spring-loaded sensor 54 can be an LVDT or photoelectric transducer. These may be equipped with an oscillator/demodulator using a DC input signal with a plus/minus DC output, capable of driving a motor controller for either a DC or an AC positioning motor. These LVDT oscillator/demodulator packages are commercially available.

Allowance must be made to rotate sewing head 40 up to 180°. For this reason, table top 14 must be cut to allow a clearance 66 for sewing head 40 to rotate. In order to avoid material 24 from falling into the cut-out area, clearance 66 and a cover guide pan 68 can be attached to sewing head 40 and rotate with sewing head 40 to cover this opening and allow material 24 to be guided into place.

In instances when material 24 has an adhesive-type or sticky backing, a sheet of paper can be placed on table top 14 to provide a low-friction surface so that material 24 can freely rotate. This paper would be cut so as not to cover dial plate 22.

The ability to use the positioning system described above with other contour-following techniques is possible. Such contour-following techniques would include a knife for cutting or trimming, a water jet, or similar applications. In place of sewing head 40, other mechanisms can be used by placing a contoured lightweight fiberboard on dial plate 22 and setting the material to be cut over this fiberboard. The operation of such a system would be similar to the sewing technique described above, except that dial plate 22 would need to be driven.

Many types of sewing machines can be used as sewing machine 50 in the present invention. Examples of such sewing machines include those manufactured by Consolidated Sewing Machine Corporation, New York, N.Y. under the trade name CONSEW®. Specific examples include CONSEW® Model 206RB-4; CONSEW® Model PCB-1; CONSEW® Model PCB-2; and CONSEW® Model 733R-4.

The present invention is also directed to a method for binding material, especially carpet pads. The method is initiated by an operator inserting the binding material into a binder guide and placing the material 24 which edges are to be bound onto table top 14 such that material 24 is approximately centered over dial plate 22. A weight may be placed on material 24 to prevent shifting of material 24 during sewing. First palm-start button 26 and second palm-start button 28 are pushed and linear actuator 38 moves dial plate 22 and material 24 toward sewing head 40.

Sewing head 40 rotates approximately 20° clockwise and stops. When material 24 reaches sewing head 40, sewing head 40 rotates in a counterclockwise direction to make a "swipe" with binder material to assist in placing the binder in the proper start position before sewing needle 44 penetrates material 24. When this "swipe" is complete and sewing head 40 moves back to the center location, the sewing cycle begins. First spring-loaded sensor 46 and second spring-loaded sensor 54 detect the location of the edge of material 24 and continuously correct both the position of linear actuator 38 and the angular location of sewing head 40 to provide a normal thread stitch.

The action of sewing needle 44 and a presser foot (not shown) pull material 24, which causes material 24 along with dial plate 22 to rotate. When a complete rotation of material 24 is detected, the sewing stops. The operator cuts the binder material and again "starts" the operation where the short piece of cut binder material is attached to material 24. The sewing again stops at the completion of sewing the short section of binder material.

At this point, the operator rotates the sewing spindle to remove the needle from material 24 and then cuts the binder material thread and removes the completely edge-bound material 24 from table top 14. First palm-start button 26 and second palm-start button 28 are pushed and dial plate 22 is returned to the "home" position for loading of another section of material 24. The shape of the subsequent section of material 24 does not have to be the same as the first section of material 24. Different shapes and sizes can be sewn without any machine setup changes.

The invention has been described with reference to the preferred embodiment. Obvious modifications and alterations will occur to others upon reading and understanding the preceding detailed description. It is intended that the invention be construed as including all such modifications and alterations insofar as they come within the scope of appended claims or the equivalents thereof.

We claim:

1. A contour following machine for altering the edge of a material comprising:

a horizontal work surface;

a dial plate through which a vacuum may be drawn, situated on the horizontal work surface;

an edge-altering device;

a rotary table upon which the edge-altering device is positioned; and a cut-out channel through which a connection between the dial plate and a linear actuator is established, wherein the edge-altering device is at an end of the horizontal work surface and the cut-out channel extends from the edge-altering device end of the horizontal work surface to a far end of the cut-out channel, which is located at a position extending beyond a center point of the work surface from the edge-altering device end of the horizontal work surface such that the dial plate can be moved to any position between the far end of the cut-out channel and the edge-altering device end of the cut-out channel.

2. The contour following machine of claim 1, wherein the edge-altering device is selected from the group consisting of a sewing machine, a knife, and a water jet.

3. The contour following machine of claim 1, wherein the edge-altering device is a sewing machine, which includes a sewing head with a sewing needle.

4. The contour following machine of claim 1, wherein the rotary table is rotated by a motor.

5. The contour following machine of claim 1, wherein the dial plate is moved along the cut-out channel by a linear actuator, which is moved by a motor.

6. The contour following machine of claim 1, wherein a first sensing arm is located near the edge-altering device and is attached to a first spring-loaded sensor, and a second sensing arm is located near the first sensing arm and is capable of detecting changes in the straight line of an edge of a material being bound, the second sensing arm being attached to a second spring-loaded sensor; wherein a response from the first spring-loaded sensor is used to control the movement of the dial plate along the cut-out channel, and a response from the second spring-loaded sensor is used to control the rotation of the edge-altering device by way of a motor, which rotates the rotary table.

7. The contour following machine of claim 1, further comprising at least one palm-start button.

8. The contour following machine of claim 1, further comprising at least one emergency shut-off button.

9. The contour following machine of claim 1, wherein the horizontal work surface is a table top.

10. The contour following machine of claim 1, wherein the material is placed on the horizontal work surface, wherein a portion of the material covers and rests on top of the dial plate.

11. The contour following machine of claim 6, wherein the first spring-loaded sensor and the second spring-loaded sensor are linear velocity displacement transducers.

12. The contour following machine of claim 1, wherein a vacuum is applied to the dial plate to hold the material in place.

13. The contour following machine of claim 1, further comprising an arm extending from the edge-altering device end of the horizontal work surface, wherein the arm applies pressure to the top of the material and the dial plate by activating a solenoid pressure plate.

14. A binding machine for binding the edge of a material comprising:

a horizontal work surface;

a dial plate through which a vacuum may be drawn, situated on the horizontal work surface;

a sewing machine, which includes a sewing head with a sewing needle;

a first sensing arm located near the sewing head, which is attached to a first spring-loaded sensor;

a second sensing arm located near the first sensing arm capable of detecting changes in the straight line of an edge of the material being bound, the second sensing arm attached to a second spring-loaded sensor;

a rotary table upon which the edge-altering device is positioned; and a cut-out channel through which a connection between the dial plate and the vacuum is established, wherein the sewing machine is at an end of the horizontal work surface and the cut-out channel extends from the sewing machine end of the horizontal work surface to a far end of the cut-out channel, which is located at a position extending beyond a center point of the work surface from the sewing machine end of the horizontal work surface such that the dial plate can be moved to any position between the far end of the cut-out channel and the sewing machine end of the cut-out channel, and wherein a response from the first spring-loaded sensor is used to control the movement of the dial plate along the cut-out channel and a response from the second spring-loaded sensor is used to control the rotation of the sewing machine by way of a motor, which rotates the rotary table.

15. The binding machine of claim 14, wherein the dial plate is moved along the cut-out channel by a linear actuator, which is moved by a motor.

16. The binding machine of claim 14, further comprising at least one palm-start button.

17. The binding machine of claim 14, further comprising at least one emergency shut-off button.

18. The binding machine of claim 14, wherein the horizontal work surface is a table top.

19. The binding machine of claim 14, wherein the material is placed on the horizontal work surface, wherein a portion of the material covers and rests on top of the dial plate.

20. The binding machine of claim 14, wherein the first spring-loaded sensor and the second spring-loaded sensor are linear velocity displacement transducers.

21. The binding machine of claim 14, wherein a vacuum is applied to the dial plate to hold the material in place.

22. The binding machine of claim 14, further comprising an arm extending from the edge-altering device end of the horizontal work surface, wherein the arm applies pressure to the top of the material and the dial plate by activating a solenoid pressure plate.

23. A method of binding a material using a binder machine comprising:

inserting a binding material into a binder guide;

placing the material onto a horizontal work surface such that material is approximately centered over a dial plate through which a vacuum may be applied;

moving the material by way of a linear actuator, which moves the dial plate and the material along a cut-out channel in the horizontal work surface toward a sewing head of a sewing machine, which rests on a rotating table at a sewing machine end of the horizontal work surface;

rotating the rotating table such that the sewing machine and the sewing head are in a start position;

beginning a sewing cycle by penetrating the material with a sewing needle on the sewing head and beginning to sew using the sewing machine;

detecting the location of the edge of the material using a first sensing arm connected to a first spring-loaded sensor and a second sensing arm connected to a second spring-loaded sensor;

correcting the position of linear actuator and the angular location of the sewing head to provide a normal thread stitch, such that the sewing head maintains a tangential orientation to the edge of the material;

pulling the material through the sewing head by way of the action of the sewing needle and a presser foot;

detecting complete rotation of the material;

rotating the sewing spindle to remove the needle from the material;

cutting the binder material thread; and removing the completely edge-bound material from the horizontal work surface.

24. The method of claim 23, wherein a weight is placed on the material to prevent the material from shifting during sewing.

25. The method of claim 23, wherein the sewing operation is initiated by pushing one or more palm-start buttons.

26. The method of claim 23, wherein the start position is established by the sewing head rotating about 20° clockwise, and when the material reaches the sewing head, rotating the sewing head in a counterclockwise direction to make a swipe with binder material.

27. The method of claim 23, wherein the start position is such that the sewing head is at an approximate right angle to the dial plate.

28. The method of claim 23, wherein the binding machine has at least one emergency shut-off button.

29. The method of claim 23, wherein the first spring-loaded sensor and the second spring-loaded sensor are linear velocity displacement transducers.

30. The method of claim 23, wherein complete rotation of the material is detected by the dial plate rotating 360° which causes a detector switch to actuate and stop the sewing operation.

31. The method of claim 23, wherein the speed of sewing is slowed, when the sewing head rotates around a radius, by combining the proportional variation of a sensing signal from the second sensing arm and a sensing signal from the first sensing arm with the manual speed setting of the sewing head and using the differential as the resultant sewing speed.

32. The method of claim 31, wherein the signal combining function is carried out using an operational amplifier, wherein the combining of the two sensing signals controls the sewing speed.

33. The method of claim 23, wherein a vacuum is applied to the dial plate to hold the material in place.

34. The method of claim 23, wherein an arm, which extends from the sewing machine end of the horizontal work surface, applies pressure to the top of the material and the dial plate by activating a solenoid pressure plate.

* * * * *